US007832589B2

(12) United States Patent
Dunwoody et al.

(10) Patent No.: US 7,832,589 B2
(45) Date of Patent: Nov. 16, 2010

(54) RECLOSABLE METAL CONTAINER

(75) Inventors: Paul Robert Dunwoody, Wantage (GB); Philip Alan Marriott, Grove (GB); Sudesh Kumar Nayar, Swindon (GB); Andrew Philip Pavely, Lower Blunsdon (GB)

(73) Assignee: Crown Packaging Technology, Inc., Alsip, IL (US)

( * ) Notice: Subject to any disclaimer, the term of this patent is extended or adjusted under 35 U.S.C. 154(b) by 518 days.

(21) Appl. No.: 10/581,272

(22) PCT Filed: Nov. 22, 2004

(86) PCT No.: PCT/EP2004/013215

§ 371 (c)(1),
(2), (4) Date: Jun. 1, 2006

(87) PCT Pub. No.: WO2005/058716

PCT Pub. Date: Jun. 30, 2005

(65) Prior Publication Data

US 2007/0102434 A1 May 10, 2007

(30) Foreign Application Priority Data

Dec. 17, 2003 (EP) ..... 03257941

(51) Int. Cl.
*A47G 19/22* (2006.01)

(52) U.S. Cl. ..... 220/711; 220/288; 220/713; 220/906

(58) Field of Classification Search ..... 220/711, 220/713, 729, 731, 741, 742, 601, 619, 627, 220/288, 906; 215/42, 44
See application file for complete search history.

(56) References Cited

U.S. PATENT DOCUMENTS

| | | | | |
|---|---|---|---|---|
| 2,105,027 | A | 1/1938 | Davis | |
| 2,153,263 | A * | 4/1939 | Martter et al. | 220/277 |
| 2,339,763 | A | 1/1944 | Calleson et al. | |
| 2,864,529 | A | 12/1958 | Henchert | |
| 4,883,192 | A | 11/1989 | Krugman | |
| 5,071,042 | A * | 12/1991 | Esposito | 222/570 |
| 5,884,679 | A * | 3/1999 | Hansen et al. | 141/386 |
| 6,010,028 | A * | 1/2000 | Jordan et al. | 220/669 |

FOREIGN PATENT DOCUMENTS

| | | |
|---|---|---|
| DE | 30 05 378 | 8/1980 |
| DE | 299 80 137 U1 | 8/2001 |
| EP | 0 443 558 A1 | 8/1991 |
| JP | 10-167356 | 6/1998 |

* cited by examiner

*Primary Examiner*—Harry A Grosso
(74) *Attorney, Agent, or Firm*—Woodcock Washburn LLP

(57) ABSTRACT

A reclosable metal container in the style of a bottle-shaped can has a conventional can body of steel or aluminum to which a metal neck component is seamed. A sleeve of plastics fits over the neck component and a detent inside the sleeve clips it onto the seam. The upper edge of the sleeve is fixed in place by a curl on the upper edge of the neck component. By using a separate neck component and hiding the seam under a sleeve, conventional sizes and material gauges can be used for the can body. Thicker material may be used for the neck component in order to withstand necking forces. Threads for closing the container may be provided either on the sleeve or, in an embodiment where the sleeve is simply used to cover the seam, on a cylindrical part of the neck component itself.

6 Claims, 2 Drawing Sheets

RECLOSABLE METAL CONTAINER

Figure 1:
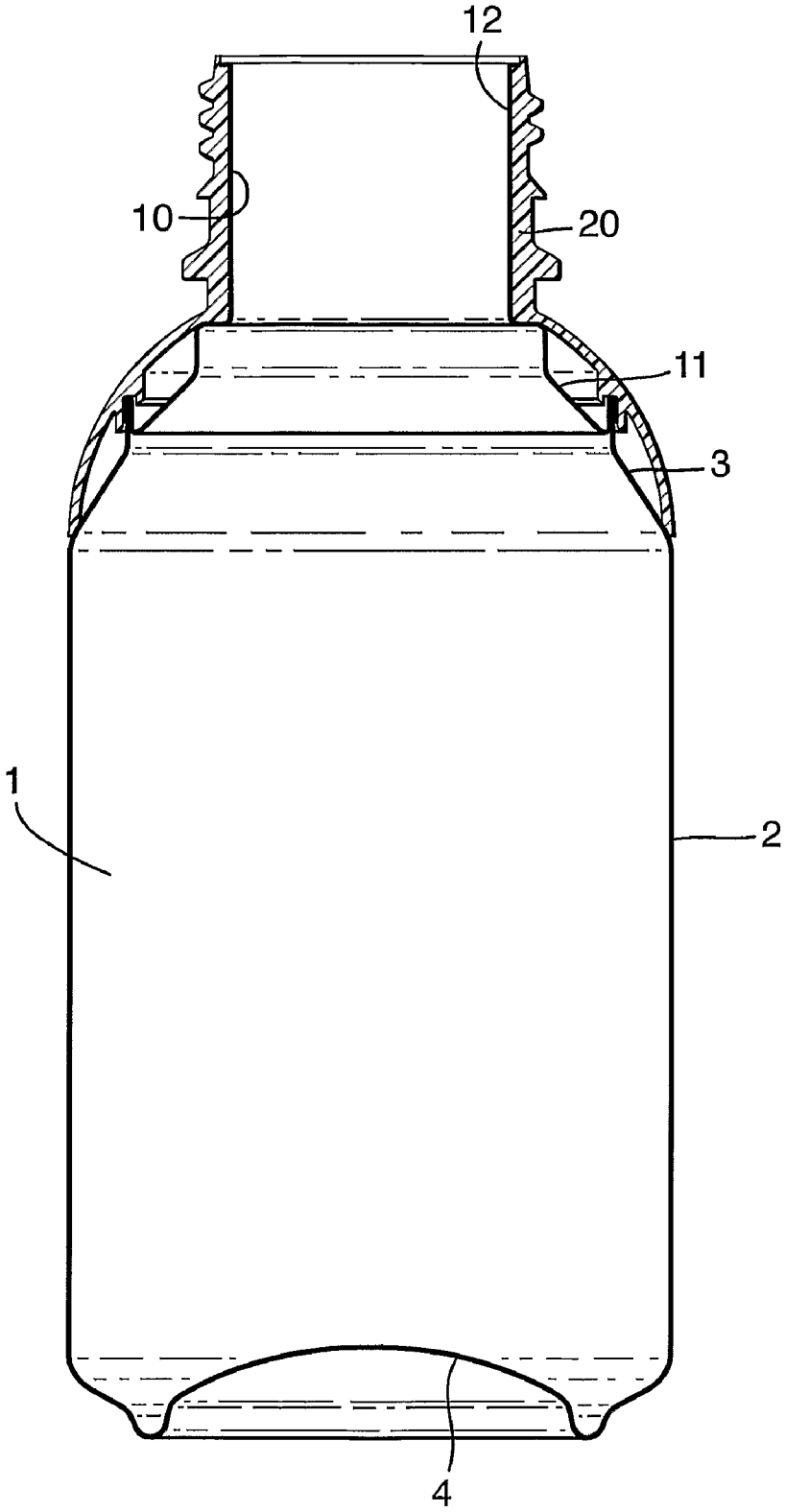

This invention relates to a reclosable metal container such as a can of steel or aluminium. In particular, but not exclusively, it relates to a bottle-shaped can for packaging beverages.

So-called "bottle cans" have been proposed in patent applications such as JP-A-2003165539, for example, in which a container body is closed at one end by a can end seamed to the body to form a base, and at the opposite end is necked inwardly to form a shoulder. A portion of the can body extends away from the free edge of the shoulder into a cylindrical portion which is threaded so as to be closed by a screw closure.

Alternative proposals for bottle cans use plastic collets to provide a thread for reclosing the can instead of threading the metal neck.

U.S. Pat. No. 2,864,529 describes an overcap for a metal containers having a cone or raised top, the overcap covering a seam which joins the cone to the body of the container. DE 29980137 U describes a plastic component which covers the seam between a neck component and a can body. JP 10 167356 A describes a shoulder cover for fixing a cap which is removeably mounted on a container body.

Whilst these current proposals are workable in theory, there are, in practice, a number of practical problems. Necking of the container body sufficiently to provide a neck finish for reclosing may involve up to 56 necking stages. Because of its material properties, this is not usually possible if the container is made of steel of conventional thickness (for example 0.08 mm). In order to withstand necking forces, the steel would need to be thicker than is conventional and therefore less economic to use. Furthermore, less metal exposure is acceptable with steel than with aluminium.

Non-standard sizes of can bodies may need to be used since a standard 355 ml capacity can with a plastic screw threaded neck would be too tall for manufacturing lines.

This invention seeks to overcome these problems and to provide a bottle can which enables standard tooling to be used, irrespective of the desired neck finish.

According to the present invention, there is provided a reclosable container comprising a metal can body having a base and a side wall, a metal neck component seamed to a free end of the can body, the neck component comprising a generally frustoconical shoulder portion and a cylindrical portion, the container further comprising a sleeve which fits over the metal neck component and covers the seam between the neck component and can body; characterised in that the sleeve is of plastics material, extends over the cylindrical portion of the neck component and is threaded to allow reclosability of the container.

It should be noted that the term "generally frustoconical" is intended herein to mean both a precise frustoconical shape and shapes which reduce the cross-sectional area of the container such as a stepped shoulder portion.

The can body is typically a standard beverage can body which can be mass-produced using regular beverage can manufacturing lines. Different neck finishes can be offered by a range of neck components and plastic sleeves. The can body may be made from steel or aluminium of thin gauges such as 0.1 mm for aluminium, 0.08 mm for steel. The neck component may be of thicker material and provides barrier properties to prevent, for example, passage of gas which may affect the product in the container.

According to a preferred aspect of the invention, the sleeve includes a detent for fixing the sleeve onto the seam. This detent provides a seal to prevent water ingress. Ideally the open end of the sleeve may be retained by a curl on the neck component. Generally the can body has a small necked-in region at the end to which the neck component is seamed. The sleeve may extend over this region on the can body so as to fit against the can body side wall and resist water ingress.

The sleeve may be profiled so as to correspond to the shoulder shape on a conventional plastic bottle. In this embodiment the neck component includes a support region between the frustoconical and cylindrical portions. This support region may be a second cylindrical portion of larger diameter than the first cylindrical portion such that the first cylindrical portion supports the threaded part of the plastic sleeve and the second portion supports a part of the sleeve which is profiled to a shoulder shape.

Figure 2:
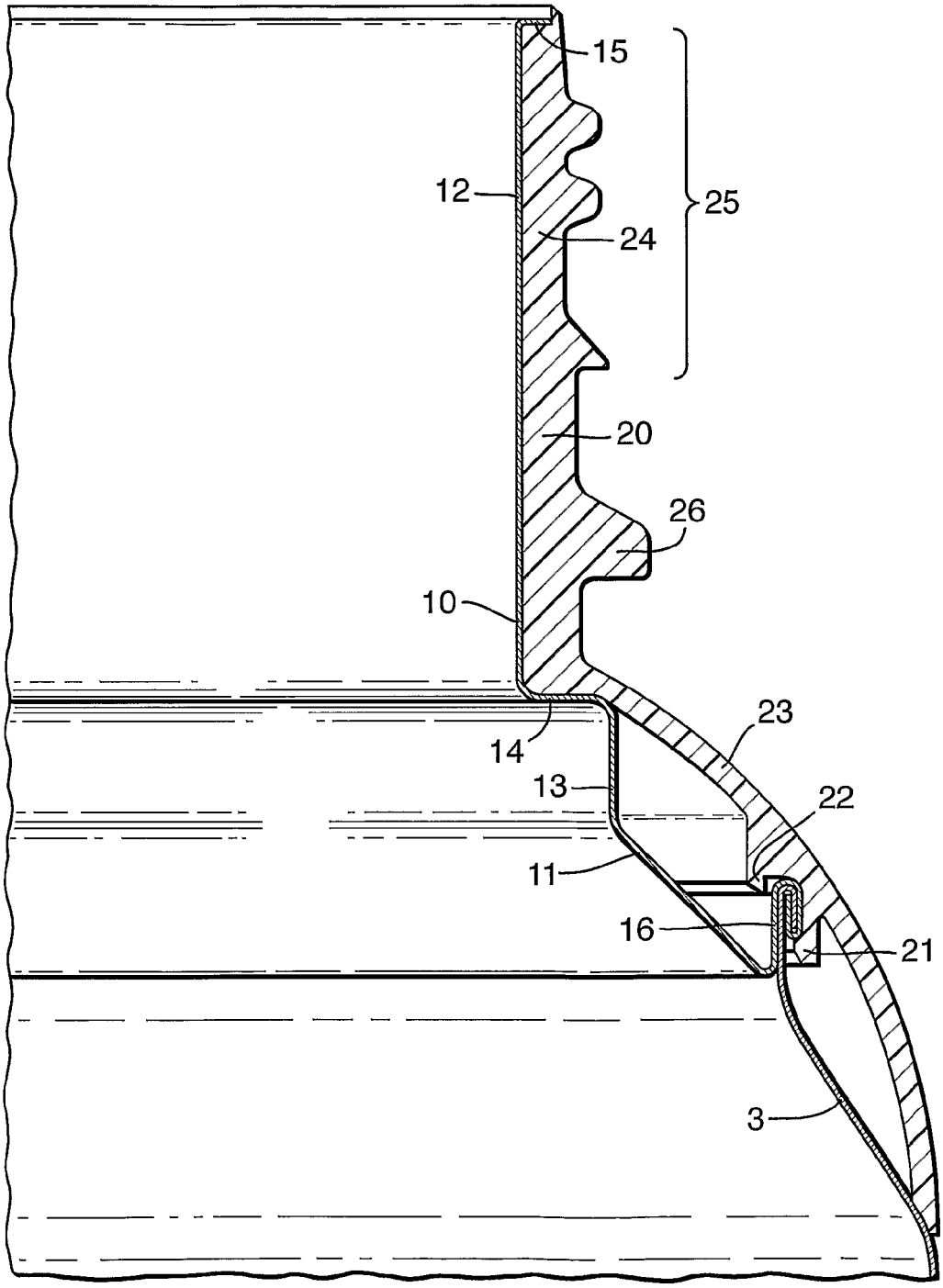

Preferred embodiments of the invention will now be described, by way of example only, with reference to the drawings, in which:

FIG. 1 is a schematic side section of a first embodiment of container according to the invention; and FIG. 2 is an enlarged side section of the shoulder and neck region of the container of FIG. 1.

FIG. 1 shows a container comprising a can body 1, neck component 10 and sleeve 20. The can is a typical beverage can body comprising a side wall 2, necked at its upper end 3, and an integral domed base 4. The can body is made of sheet metal, typically steel or aluminium in the range of 0.25 mm to 0.35 mm thick with walls reduced in thickness during manufacture.

Neck component 10 comprises a metal support having a generally frustoconical part 11 and a cylindrical portion 12. As best shown in FIG. 2, a second cylindrical portion 13 is joined to the first cylindrical portion by a shoulder 14. The neck component terminates in a flange or, ideally, curl 15 at its upper end which holds the plastic sleeve 20 in position. The sleeve thus also hides the cut edge of the neck component. At its lower end the neck component is fixed by a double seam 16 to the can body 1.

If the container is closed by a plastics closure having a bore seal, the bore seal will impart further cut edge protection. In this instance the cut edge of curl 15 would be trapped between the sleeve 20 and the bore seal of the closure.

The sleeve 20 has a curved sheath 23 with a hook-shaped detent 21 which clips onto the seam 16. Annulus 22 provides further location of the sleeve over the seam. The sleeve of FIGS. 1 and 2 is thus fixed in position by the detent 21 and neck component flange 15. In this embodiment, the sleeve 20 has a cylindrical upper portion 24 which is threaded 25. Below thread 25 the upper portion includes a neck support ring 26 for handling purposes.

For aesthetic reasons the sleeve may be shaped so as to blend into the side wall of the can body. The sleeve may be made of thin plastics so that extra support for the curved shape is provided by shoulder 14 of the neck component.

What is claimed is:

1. A reclosable beverage container comprising:

a metal can body having a base and a side wall, a metal neck component seamed to a free end of the metal can body, the metal neck component formed as a one-piece unit including a generally frusto-conical portion and a cylindrical portion joined to the frusto-conical portion by a shoulder, and a sleeve which fits over the metal neck component and covers the seam between the neck component and the metal can body;

wherein (i) the sleeve is of a plastics material, and extends over the cylindrical portion of the neck component, the generally frusto-conical portion of the neck component, and a portion of the side wall, (ii) the sleeve is at least partially supported by the seam and the shoulder, and (iii) the sleeve is threaded to allow reclosability of the container.

2. A container as defined in claim 1, in which the sleeve includes a detent for attaching the sleeve onto the seam.

3. A container as defined by claim 1, wherein the shoulder is substantially perpendicular to the cylindrical portion.

4. The container as defined in claim 2, wherein the shoulder is substantially perpendicular to the cylindrical portion.

5. A container as defined in claim 1, wherein the sleeve is circumferentially continuous.

6. A container as defined in claim 1, in which the sleeve does not alter flow from the metal container.

* * * * *